US011911668B2

(12) United States Patent
Lally

(10) Patent No.: US 11,911,668 B2
(45) Date of Patent: Feb. 27, 2024

(54) LACROSSE BALL COLLECTION APPARATUS

(71) Applicant: Robert Lally, Timonium, MD (US)

(72) Inventor: Robert Lally, Timonium, MD (US)

( * ) Notice: Subject to any disclaimer, the term of this patent is extended or adjusted under 35 U.S.C. 154(b) by 883 days.

(21) Appl. No.: 16/931,893

(22) Filed: Jul. 17, 2020

(65) Prior Publication Data

US 2021/0268339 A1 Sep. 2, 2021

Related U.S. Application Data

(60) Provisional application No. 62/850,593, filed on May 21, 2019.

(51) Int. Cl.
*A63B 47/02* (2006.01)
*A63B 102/14* (2015.01)

(52) U.S. Cl.
CPC ..... *A63B 47/025* (2013.01); *A63B 2102/14* (2015.10)

(58) Field of Classification Search
CPC . A63B 47/025; A63B 2102/14; B65F 1/1415; B65F 2240/138; A01D 2046/262; A01K 77/005
USPC ..... 294/19.2, 214
See application file for complete search history.

(56) References Cited

U.S. PATENT DOCUMENTS 4,561,480 A * 12/1985 Underwood ..... A01G 20/43 383/117
5,269,527 A * 12/1993 Noval ..... A63B 71/022 473/421
5,451,107 A * 9/1995 Ricker ..... B65F 1/00 383/34
5,497,580 A * 3/1996 Vanderplaats ..... A01K 77/00 43/12
7,543,821 B2 * 6/2009 Winningham ..... A63B 63/004 273/400
2013/0045815 A1 * 2/2013 Cho ..... A63B 47/025 473/197
2018/0015344 A1 * 1/2018 Mullen ..... A63B 69/0024
2019/0083870 A1 * 3/2019 Kapsalis ..... A63B 69/002

* cited by examiner

*Primary Examiner* — Dean J Kramer
(74) *Attorney, Agent, or Firm* — Offit Kurman, P.A.; Joseph P. Mathew

(57) ABSTRACT

The invention is that of a lacrosse ball collection apparatus fabricated from materials such as plastics, metals and fabrics. The apparatus comprises a fabric which when in its open position forms a substantially triangular horizontal surface capable of fitting inside a lacrosse goal. When lacrosse balls are shot into the goal, they collect on the fabric. The apparatus is foldable at a front joint and comprises a spout located behind the front joint and in close proximity thereto, such that the apparatus may be used to carry the balls to a collection receptacle, where they may be poured out of the spout into the receptacle for reuse. The apparatus is further foldable at two side joints such that an apical joint is foldable toward the front joint and two front member segments are foldable inward to render the apparatus in a compact, closed position suitable for storage in small spaces.

15 Claims, 4 Drawing Sheets

LACROSSE BALL COLLECTION APPARATUS

CROSS REFERENCE TO RELATED APPLICATIONS

This application claims the benefit of priority of U.S. Prov. Pat. App. No. 62/850,593, filed May 21, 2019, the contents of which are hereby incorporated by reference into this application in their entirety.

STATEMENT REGARDING FEDERALLY SPONSORED RESEARCH

The invention described in this application was developed without federal funding.

BACKGROUND OF THE INVENTION

Lacrosse is one of the fastest growing sports in the United States. Lacrosse is a goal sport that requires shooters to practice taking shots on goal if they are to improve their accuracy and their effectiveness as offensive scorers. Having multiple players on a team take shots on goal one after the other during practice is also a method for training the team goaltender. As a result, coaches employ drills of this nature, which leads to some of the balls shot being caught or deflected by the goaltender, with others passing the goaltender and entering the goal, where they accumulate after multiple shots are taken.

The front of a lacrosse goal is in the shape of a rectangular frame formed by two vertical posts with an upper crossbar between them. The posts are connected to a supporting base formed by two "flat irons" that extend backward and inward from the bottom of the vertical posts to a point where they meet to form a triangular base that lies on the ground. Netting is affixed to the posts, crossbar and flat irons to prevent balls entering the goal—many times at high velocity—from rolling past the back of the base. Once balls accumulate in the back of the goal, they become difficult to reach and gather, leading to time-consuming efforts to return them to the shooters for continued play and wasted practice time. Thus, there is a need for a lacrosse ball collection apparatus as described herein among coaches and players of the sport to expedite the collection of lacrosse balls from the goal and make practices more efficient.

BRIEF SUMMARY OF THE INVENTION

The invention of the present disclosure is that of a lacrosse ball collection apparatus comprising a front member and two side members that form an essentially equilateral triangular shape of similar but slightly smaller size to that of a lacrosse goal base that can be laid on the ground or playing surface inside a triangular lacrosse goal base and occupy the open triangular ground surface defined by the flat irons and the vertical plane extending downward from the crossbar. A netting or mesh material is temporarily or permanently affixed to the members of the apparatus such that balls shot on goal may accumulate within the boundaries of the apparatus on top of the netting or mesh.

A front member of the apparatus spans a large portion of a width of the goal between the posts and defined by the length of the crossbar and comprises two front member segments (left and right) and a front joint, preferably centrally located across the front member length, at which the front member segments may fold toward one another. The apparatus further comprises two front end joints, one located at each outer end of the front member and connecting each outer end of the front member segments to the front end of a front side member.

Each side member (left and right) spans a length similar to or slightly less than the flat irons of a lacrosse goal and comprises a centrally located side joint connecting a front and rear side member segment. The rear side member segments are foldable at the side joints such that rear side member segments are foldable together toward the front joint to an intermediate position when the apparatus is being folded up for storage. In one embodiment, the rear ends of the rear side member segments are connected at an apical joint. The apparatus may then be folded up for storage by folding the apical joint inward toward the front joint, forming two triangular "halves" of the apparatus, then folding the front member segments toward one another such that the apparatus when fully folded up in this manner (closed position) requires a much smaller storage space than the apparatus when unfolded for use (open position).

DETAILED DESCRIPTION OF THE INVENTION

A lacrosse ball collection apparatus of the present disclosure may be configured to cover the maximum amount of ground area within the lacrosse goal ground area. A lacrosse goal ground area is typically defined by the goal specifications, for example and not by way of limitation, those set by the National Collegiate Athletic Association (NCAA). According to NCAA specifications, the front opening of a lacrosse goal formed by the opening or "goal mouth" within the two side posts and upper crossbar has inner dimensions of six feet in height and width. Thus, a front member of a lacrosse goal collection apparatus may have a total length of no more than six feet when in its open position, ready to use. Further, the flat irons of an NCAA compliant goal should extend back from the goal side posts and meet at a point that is seven feet back from the horizontal center of the goal mouth. As such, the side members of the invention of the present disclosure should form sides capable of fitting within the area defined by the flat irons and width of the goal mouth.

Figure 1:
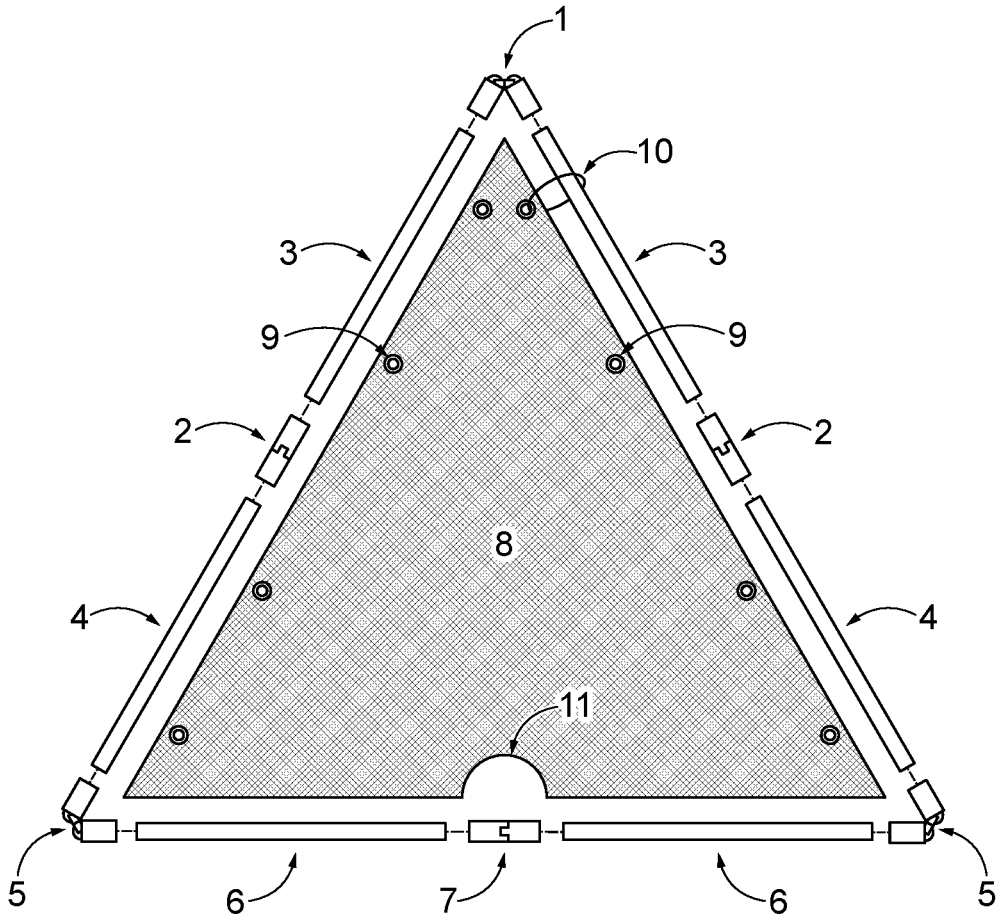
FIG. 1 shows a top view of lacrosse ball collection apparatus of the present invention in its open position for use inside a lacrosse goal.

FIG. 1 shows a top view of lacrosse ball collection apparatus of the present invention in its open position for use inside a lacrosse goal with apical joint 1 connecting two rear side member segments 3 (left and right), each of which are in turn connected via a side joint 2 to a corresponding front side member segment 4, each of which are in turn connected via a front end joint 5 to the outer end of a front member segment 6, with the inner end of each front member segment 6 being connected to one another by a centrally located front joint 7. A substantially equilateral triangular mesh 8 is fastened temporarily or permanently at multiple fastening points 9 to the front member and side members by fasteners 10. A spout 11 is centrally located at the front of the mesh 8 proximal to the front joint 7 such that when balls are collected on the mesh 8 during use, they can be poured out of the apparatus by folding the apparatus at the front joint 7 and tilting the apparatus slightly forward above a receptacle suitable for collecting the balls as they pour out. The outer dimensions of the apparatus ideally allow the apparatus to cover the maximum ground surface area within the goal, or slightly less to allow for ease of placement and room behind the plane of the goal mouth where a goalie might place his or her feet.

A lacrosse ball collection apparatus of the present invention may be constructed of using any suitable materials. In certain embodiments, the front member segments, side members and joints may be fabricated of lightweight but durable material such as polyvinyl chloride or equivalent. Any thermoplastic, metal or alternative materials may be used to enable the invention, although preferred embodiments will be lightweight and durable. A suitable mesh material may be used to contain the balls, such as a nylon mesh or the like. One of ordinary skill in the art, however, will appreciate that any material of sufficient strength and flexibility to support several lacrosse balls and be configured with multiple fastening points for fastening to the front member and side members while allowing water to drain though is desirable.

Fasteners 10 may be in the form of pull-ties, hook and loop fasterers, rope, string, wire or any other material capable of being used to keep the mesh 8 in position when in use, and to allow the mesh 8 to hold the weight of several lacrosse balls when an apparatus of the present disclosure is in its intermediate position (shown in FIG. 2) so the apparatus can be carried to a receptacle for the balls, such as a five-gallon pail, and poured into the receptacle through the spout 11.

Figure 2:
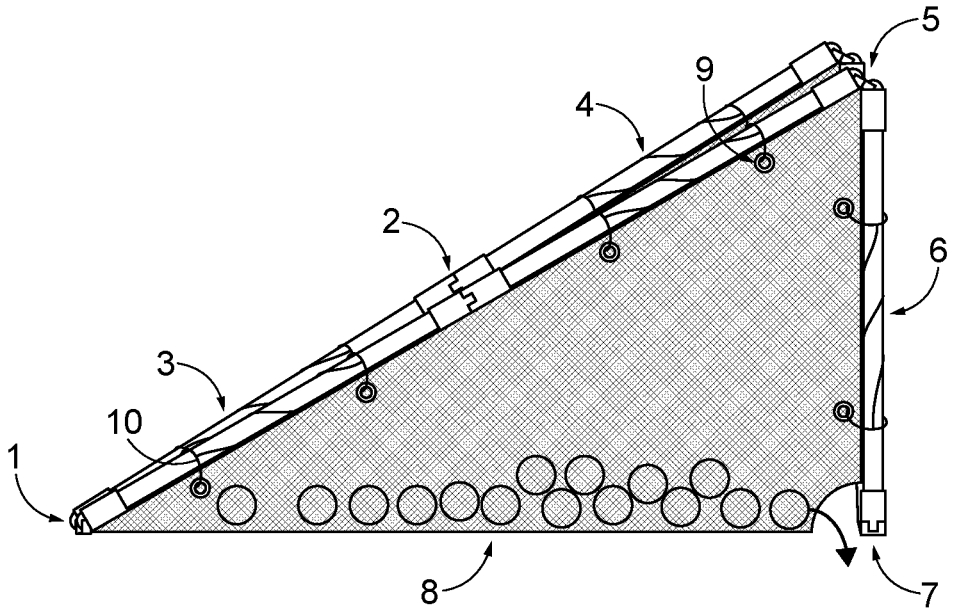
FIG. 2 shows a side view of a lacrosse ball collection apparatus of the present invention in its intermediate position.

FIG. 2 shows a side view of a lacrosse ball collection apparatus of the present invention in its intermediate position, wherein the front member segments 6 are folded inward toward one another at the front joint 7 after lacrosse balls have been collected on the mesh 8 in order to pour the collected balls out the spout 11 into a suitable receptacle. In this position, the rear side members 3, side joints 2 and front side members 4 remain unfolded. The mesh 8 is fastened at multiple fastening points 9 by corresponding fasteners 10.

It is an object of the invention to allow for the fast collection and redistribution of balls collected on the mesh 8 during lacrosse shooting practice. To that end, the apparatus is foldable into an intermediate position as shown in FIG. 2 after all of the balls available for shooting practice have been shot on goal. Turning to FIG. 2, a user may fold an apparatus of the present invention at the front joint 7 so that the front member segments 6 fold together such that the mesh 8 forms a pouch or sac of balls that can be poured out the spout 11 into a receptacle for redistribution to the shooters and replacement or storage after practice. The mesh 8 is held taut at the fastening points 9 by fasteners 10 which are fastened to the front member segments 6 at front 4 and rear side member segments 3.

Figure 3A:
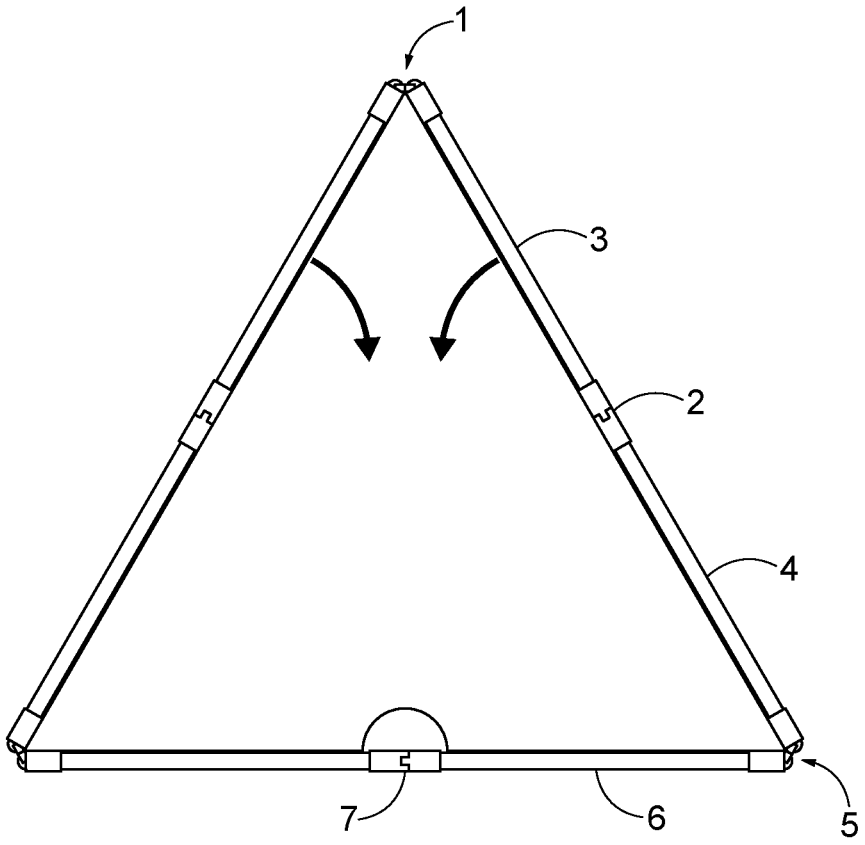
FIG. 3A shows a frame of a lacrosse ball collection apparatus of the present invention indicating the folding direction (dark curved lines) of the rear side members toward the centrally located front joint, which is the first step in the storage process.
Figure 3B:
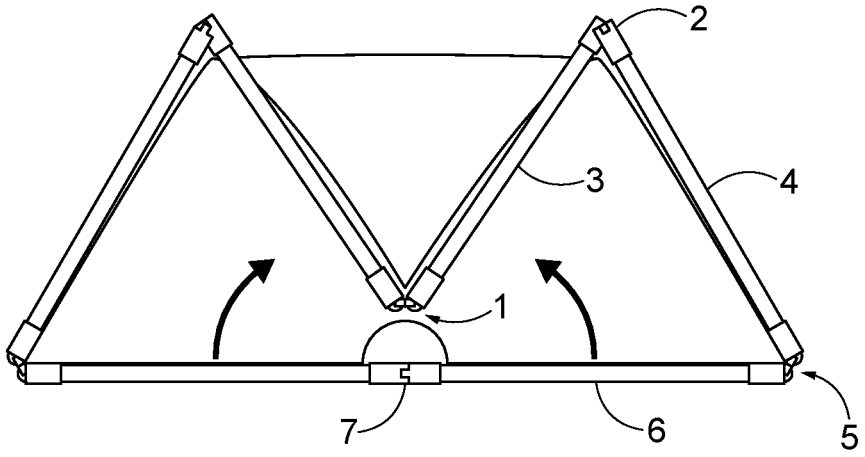
FIG. 3B shows a lacrosse ball collection apparatus as shown in FIG. 3A with the rear side members having been folded toward the centrally located front joint.
Figure 3C:
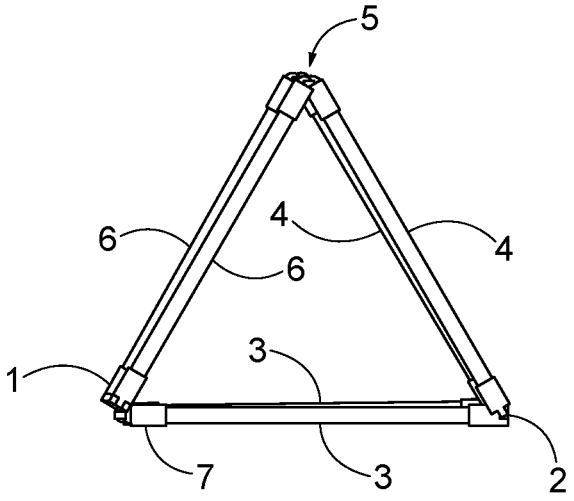
FIG. 3C illustrates a lacrosse ball apparatus of the present invention in its closed position for storage after the two front member segments have been folded toward one another at the front joint, resulting in a compact triangular configuration much smaller in size than the unfolded apparatus as used for the collection of lacrosse balls within a goal.

From the intermediate position, once emptied, an apparatus of the present invention may be further folded into a closed position for storage as shown in FIGS. 3A-3C. Turning now to FIG. 3A, the apical joint 1 is foldable toward the front joint 7 as indicated by the dark curved arrows. Folding in this manner occurs at the side joints 2 and results in the apparatus folding into the position shown in FIG. 3B. From the position shown in FIG. 3B, the apparatus is further foldable at the front joint 7 by folding the front end joints 5 and front side member segments 6 toward one another to arrive at the closed position shown in FIG. 3C, which is intended to be a storage position of an apparatus of the present invention.

An apparatus of the present invention may be provided as a kit with individual components for assembly by the user, or may be provided in assembled form. A kit requiring self-assembly comprises an apical joint 1, two side joints 2, a front joint 7, two front member segments 6, two rear side member segments 3, two front side member segments 4, a mesh 8 configured with fastening points 9, and an appropriate number of fasteners 10. Embodiments represented by the drawings show the fastening points 9 as grommets through which string, rope, twine, wire or the like may be threaded, either individually around nodes or as a continuous loop arrangement that wraps around the front and side members repeatedly. One of ordinary skill in the art, however, will appreciate the fact that any suitable means for fastening the mesh 8 to the front and side members in a manner that allows the apparatus to maintain strength necessary to support balls when in the intermediate position will suffice. Fasteners contemplated by the applicant include without limitation hook and loop fasteners, snaps, buttons, clamps and all equivalents. In certain embodiments, the mesh 8 may be configured to wrap around the front and side members and fasten such as by hook and loop fasteners, snaps, buttons or equivalent.

An apparatus provided in its assembled form may further comprise a telescoping feature such that an inner cable runs through the full perimeter of the apparatus inside the apical joint 1 rear side member segments 3 side joints 2 front side member segments 4 front end joints 5 and front member segments 6, allowing for additional compaction beyond the closed position, or only enabling folds at the side joints 2 and front joint 7, as one of ordinary skill in the art will appreciate.

A further feature of an apparatus as described herein may include wheels or casters connected temporarily to one or more points of the apparatus, preferably at the apical joint, for ease of removing the apparatus from a goal space after use.

What is claimed is:

1. A triangular lacrosse ball collection apparatus comprising:

a front member having a left front member segment and a right front member segment, connected by a front joint;

a left side member comprising a front left side member segment and a rear left side member segment connected by a left side joint;

a right side member comprising a front right side member segment and a rear right side member segment connected by a right side joint;

a left front end joint connecting the left front member segment to the front left side member segment;

a right front end joint connecting the right front member segment to the front right side member segment;

an apical joint connecting the rear left side member segment to the rear right side member segment;

a triangular fabric having a spout positioned centrally behind the front joint and a plurality of fastening points; and a plurality of fasteners corresponding to the plurality of fastening points;

wherein when assembled in an open position, the front member spans not more than six feet and each of the left side member and right side member span not more than seven feet.

2. The apparatus of claim 1, wherein the left front member segment and right front member segment are foldable at the front joint to form an intermediate position of the apparatus.

3. The apparatus of claim 2, wherein each of the members and joints are fabricated from plastic, metal or polymer material.

4. The apparatus of claim 2, wherein the fabric is water-permeable.

5. The apparatus of claim 2, wherein the plurality of fasteners is selected from the group consisting of hook and loop fasteners, rope, string, twine, pull-ties, snaps, buttons and clamps.

6. A method of collecting lacrosse balls, the method comprising:

laying an apparatus of claim 2 in its open position on a substantially horizontal surface within a space defined by two flat irons and a goal mouth of a lacrosse goal;

shooting lacrosse balls at the lacrosse goal, wherein the balls collect on the apparatus;

folding the apparatus from its open position to an intermediate position; and pouring the balls out of the apparatus through the spout into a collection receptacle.

7. The apparatus of claim 1, wherein the side joints are configured to allow the rear side member segments and apical joint to fold forward toward the front joint and the front member segments and front end joints to fold inward to form a closed position of the apparatus.

8. The apparatus of claim 7, wherein each of the members and joints are fabricated from plastic, metal or polymer material.

9. The apparatus of claim 7, wherein the fabric is water-permeable.

10. The apparatus of claim 7, wherein the plurality of fasteners is selected from the group consisting of hook and loop fasteners, rope, string, twine, pull-ties, snaps, buttons and clamps.

11. A method of collecting lacrosse balls, the method comprising:

laying an apparatus of claim 7 in its open position on a substantially horizontal surface within a space defined by two flat irons and a goal mouth of a lacrosse goal;

shooting lacrosse balls at the lacrosse goal, wherein the balls collect on the apparatus;

folding the apparatus from its open position to an intermediate position; and pouring the balls out of the apparatus through the spout into a collection receptacle.

12. The apparatus of claim 1, wherein each of the members and joints are fabricated from plastic, metal or polymer material.

13. The apparatus of claim 1, wherein the fabric is water-permeable.

14. The apparatus of claim 1, wherein the plurality of fasteners is selected from the group consisting of hook and loop fasteners, rope, string, twine, pull-ties, snaps, buttons and clamps.

15. A method of collecting lacrosse balls, the method comprising:

laying an apparatus of claim 1 in its open position on a substantially horizontal surface within a space defined by two flat irons and a goal mouth of a lacrosse goal;

shooting lacrosse balls at the lacrosse goal, wherein the balls collect on the apparatus;

folding the apparatus from its open position to an intermediate position; and pouring the balls out of the apparatus through the spout into a collection receptacle.

* * * * *